United States Patent [19]

Baker et al.

[11] 4,270,479

[45] Jun. 2, 1981

[54] TORPEDO GUARDS

[75] Inventors: Judd O. Baker, Medford Lakes, N.J.; Jerome J. O'Brien, San Francisco, Calif.; Westley F. Curtis, Carderock, Md.; Frederick M. Varney, Washington, D.C.

[73] Assignee: The United States of America as represented by the Secretary of the Navy, Washington, D.C.

[21] Appl. No.: 793,660

[22] Filed: Dec. 24, 1947

[51] Int. Cl.[3] ..... B63G 9/00

[52] U.S. Cl. ..... 114/240 A; 89/1 A; 102/211; 114/245

[58] Field of Search ..... 114/240

[56] References Cited

U.S. PATENT DOCUMENTS

| | | | |
|---|---|---|---|
| 2,060,198 | 11/1936 | Hammond | 114/21 W |
| 2,404,440 | 7/1946 | Holm | 114/240 R |
| 2,441,030 | 5/1948 | Page | 102/207 |
| 2,489,255 | 11/1949 | Barker | 102/18 R X |
| 2,668,512 | 2/1954 | Klas | 114/240 R |

*Primary Examiner*—David H. Brown

*Attorney, Agent, or Firm*—R. S. Sciascia; L. A. Marsh

EXEMPLARY CLAIM

11. In a torpedo guard, a cable, a series of explosive units strung on the cable, and individual proximity fuses positioned on said cable for each of said explosive units, the proximity fuse for any given explosive unit being adapted to fire said given unit upon the approach of a torpedo within a predetermined distance from said given unit.

13 Claims, 8 Drawing Figures

TORPEDO GUARDS

The invention described herein may be manufactured and used by or for the Government of the United States of America for governmental purposes without the payment of any royalties thereon or therefor.

The invention relates to improvements in equipment for protecting ships against torpedoes.

The primary object of the invention is to provide improved means for automatically firing any given unit in a series of underwater explosive units upon the approach of a torpedo within a predetermined distance from said given unit.

Another object of the invention is to provide protective equipment of the character described which may be conveniently carried on a ship in position for quick release into the water at any ship speed.

Another object is the provision of protective equipment of the character described which requires a minimum number of men for handling the gear.

A further object is the provision of protective equipment as described which does not seriously interfere with the speed and maneuverability of the protected ship.

A still further object is the provision of equipment which will protect a ship against a plurality of oncoming torpedoes whether approaching simultaneously or in succession.

The invention also aims to provide equipment that is relatively inexpensive so as to economically permit the discarding thereof after use whereby any risk to personnel and ship in retrieving the equipment is eliminated.

Additionally the invention aims to provide underwater towed explosive streamers having negative buoyancy sufficient to sink the streamers and thus prevent drifting of the streamers into the side of the ship in case of disablement and also to prevent entanglement of the streamers in the ship's propellers during sharp turns.

Yet another object of the invention is the provision of a sectionalized explosive streamer carrying electronic torpedo detectors and including inductive couplings for supplying the detectors with alternating current energy from the tow cable.

Other objects and advantages of the invention will become apparent during the course of the following detailed description, taken in connection with the accompanying drawings forming a part of this specification, and in which drawings, FIG. 1 is a diagrammatic plan view of a ship provided with the improved protective equipment and illustrating the relationship of parts before and during use, respectively, at the port and starboard sides of the ship.

Figure 2:
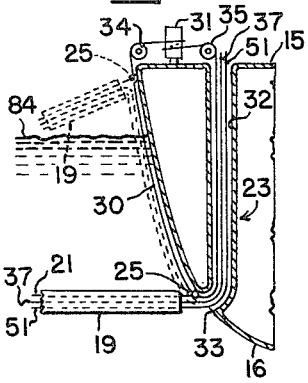
FIG. 2 is a view, partly diagrammatic and partly in vertical section transversely of the ship's bow and showing gear for vertically adjusting the towpoint of the protective equipment.
Figure 1:
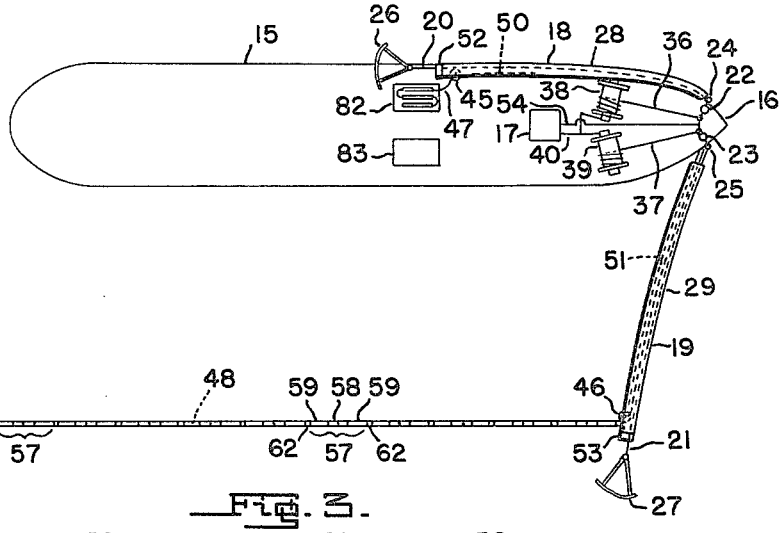
Figure 3:
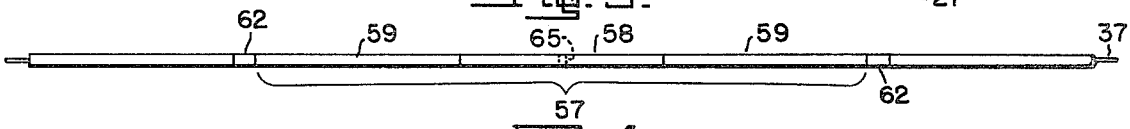
FIG. 3 is a fragmentary plan view of an explosive streamer illustrating a preferred sectional arrangement.
Figure 4:
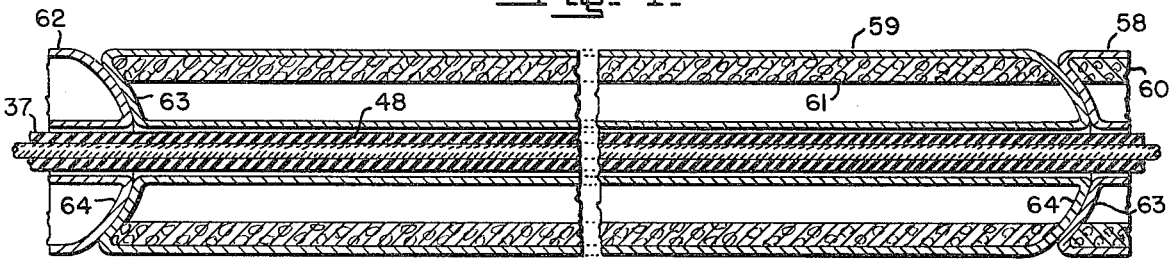
FIGS. 4, 5 and 6 are fragmentary central longitudinal sectional detail views taken at different stations along a streamer.
Figure 5:
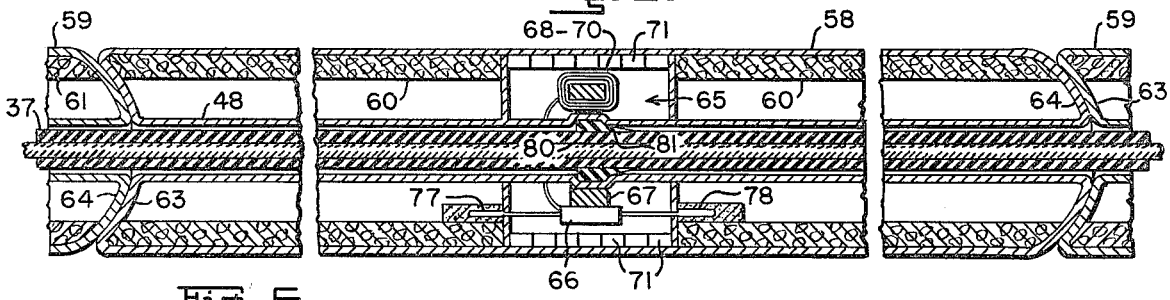
Figure 6:
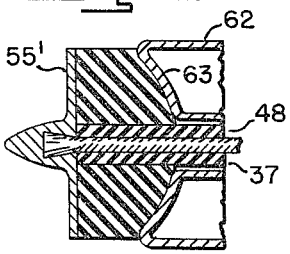

In the drawings which for the purpose of illustration show preferred and modified forms of the invention, and wherein similar reference characters denote corresponding parts throughout the views, the numeral 15 designates a ship provided at its bow 16 with an oscillation generator 17 for energizing port and starboard protective equipment 18, 19. This equipment preferably includes faired cables 20, 21 each connected at one end to gear 22, 23 at towpoints 24, 25 respectively, and each connected at their free ends to paravanes 26, 27. The cable fairings 28, 29 may be of any suitable kind, one example being shown in U.S. Pat. No. 2,397,957 granted to Freeman. The gear 22, 23 for raising or lowering the towpoints 24, 25 are similar, one gear 23 being shown in FIG. 2. This gear includes a cable 30 extending from a control drum 31 downwardly through a vertical tubular guideway 32 to an underwater opening 33, then up the outside of the ship's bow to the control drum 31 so as to form an endless cable circuit. The cable 30 may be supported as by suitable pulleys 34, 35 where desired. The inner and outer ends of the fairings 28, 29 are of course suitably anchored to the faired cables 20, 21 to prevent longitudinal movement of the fairings.

Extending through the fairings 28, 29 and the tubular guideways of the towpoint adjusting gear 22, 23 are electrically conductive insulated cables 36, 37 connected each at one end to towing winches 38, 39 at the bow of the ship. A conductor 40 from the oscillation generator is electrically connected to the cables 36, 37 at the winches 38, 39 as by the brushes 41, 42 and slip rings 43, 44 shown in FIG. 7.

Rotatably supported on the fairings 28, 29 adjacent the paravanes are pulleys 45, 46 carrying intermediate portions of the cables, 36, 37 and facilitating adjustment of the length of the free end portions 47, 48 of the cables by reeling in or paying out cable from the winches 38, 39.

Also extending through the fairings 28, 29 and the tubular guideways of the towpoint adjusting gear 22, 23 are electrically conductive insulated cables 50, 51 connected at their outer ends to electrodes 52, 53 carried by the fairings and at their inner ends to a conductor 54 from the oscillation generator 17. Instead of employing two electrodes 52, 53 on the fairings, a single electrode may be disposed in any suitable location, such as at the stern of the ship. Affixed to the free ends of the cables 36, 37 are electrodes 55, 55' whereby alternating current from the oscillation generator 17 will energize cables 36, 37 when the protective equipment is underwater.

Strung on the cables 36, 37 are tubular units 57 each comprising an intermediate section 58 and two end sections 59. These units may be formed of aluminum or aluminum alloy. Housed within the sections 58, 59 in watertight compartments are hollow cylindrical charges 60, 61. Adjacent tubular units 57 are preferably isolated by blank spacer sections 62. One end wall 63 of each section 58, 59, 62 is of concave curvature and the opposite end wall 64 of each section is of complementary convex curvature so that angular misalignment of adjacent sections is permitted. The electrodes 55, 55' are of a size to prevent sliding of the tubular sections off the free ends of the cables.

The intermediate sections 58 of the tubular units are each provided with individual echo ranging proximity fuse systems 65 for automatically firing the explosive charge of any given intermediate section upon the approach of a torpedo within a predetermined distance from said given section. Any suitable distance measuring device 66 may be used in the proximity fuse system, such as the one shown and described in U.S. Pat. No.

2,333,688 granted to Shepard, Jr. Disposed in each intermediate section 58 is a transformer core 67 carrying secondary windings 68–70 constituting an inductive coupling for supplying electric energy from the central insulated conductor cable to the electronic echo ranging proximity fuse system 65 within the section 58. The cables 36, 37 function as single turn primaries of the transformers for the several explosive units. Any suitable electro-acoustic transducer such as a piezoelectric crystal mosaic 71 may be used with the distance measuring device 66.

Figures 7, 8:
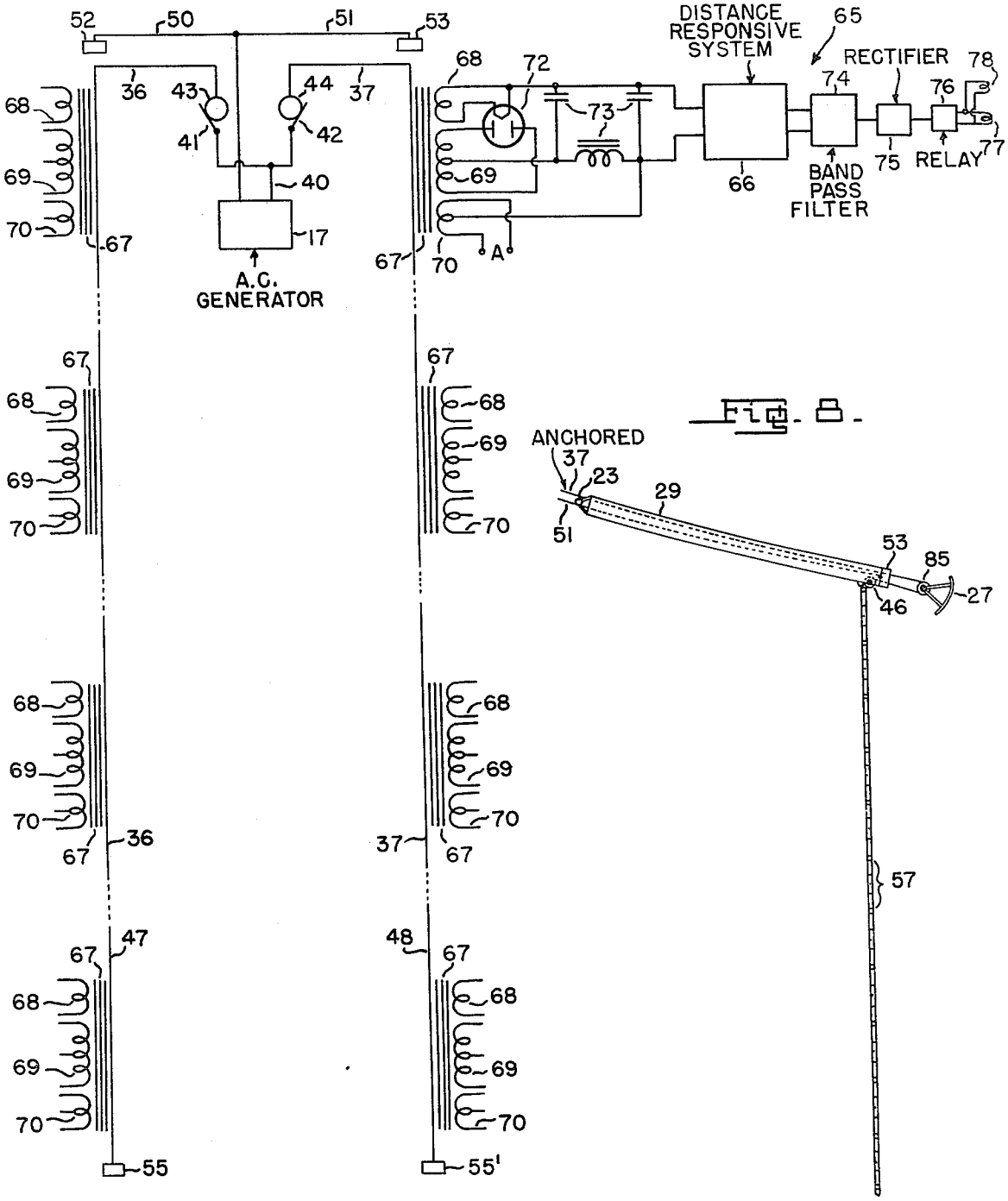
FIG. 7 is a diagrammatic view of an electronic circuit forming part of the invention.
FIG. 8 is a diagrammatic plan view of a modified system for towing a protective streamer.

In FIG. 7 only one proximity fuse system 65 is shown but obviously each transformer secondary group 68–70 may supply energy to a separate proximity fuse system 65. The windings 68–70 of each transformer are adapted to provide alternating current and the direct current necessary for operation of the system 65 is derived from a rectifier 72 and filter system 73 having its output connected to the distance measuring device 66. The output frequency of the distance measuring device 66, which varies inversely as a function of torpedo distance, is applied to a band pass filter 74 whose output is rectified at 75. When the output frequency of the distance measuring device 66 is within predetermined limits, the rectified output is adapted to effect ignition of a thyratron relay 76 controlling fuses 77, 78 arranged to fire the charges 60 in an explosive section.

During use of the equipment, sea water will find its way into the space between the cables 47, 48 and the tubular sections 58, 59 thus tending to form short circuits in the water surrounding the explosive units 57. This would seriously interfere with proper operation of the inductive couplings supplying current to the echo ranging proximity fuse systems. In order to prevent these short circuits, each tubular section may be provided intermediate its ends with an insulative packing 80 having a forwardly directed beveled annular flange 81 in wiping engagement with the cable extending therethrough. Water pressure during forward towing of the streamer will tend to maintain the forwardly directed flange 81 in sealing relation to the cable, without materially interfering with movement of the tubular sections on the cable.

In the presently preferred embodiment of the invention, the explosive units 57 are 25 feet long but by making each unit in three sections, the streamers may be stored in deck containers 82, 83 nine feet long with the individual sections 58, 59 disposed in zig-zag relation. The additional cable length required for thus folding the sections may be obtained by paying out cable from the towing winches.

During operation, the paravanes will tow the sectionalized streamers in spaced parallel relation at opposite sides of the ship 15 and transversely of the normal path of travel of a torpedo directed at the ship. After attachment of the faired paravane cables to the towpoints 24, 25, the towpoint adjusting gear 22, 23 is manipulated to lower the towpoints to positions well below the water surface 84. In the preferred embodiment of the invention, the individual echo ranging proximity fuse systems 65 are spaced at intervals of 25 feet along the sectionalized streamers, and are adapted to fire the explosive charges 60 of any given intermediate section 58 upon the approach of a torpedo within a 25 foot radius of the given section. The shock and heat produced by explosion of any given intermediate section 58 will set off the charges 61 in the next adjacent sections 59, but will not affect adjacent sectional units 57 because of the presence of the blank spacer sections 62 therebetween. The explosive charges contained in one 25 foot sectional unit 57 should be sufficient to destroy or disable the toughest torpedo within a 25 foot radius of the echo ranging proximity fuse system 65 associated with that particular unit 57.

Explosion of a unit will produce a gap in the sectionalized streamer but this gap will be automatically filled by rearward shifting of the explosive units 57 ahead of the gap under the influence of the drag produced by towing. The effective length of the trailing portions 47, 48 of the cables may be reduced by operation of the towing winches 38, 39 so that any exposed cable forwardly of the streamer units will be taken up. The sectionalized units 57 may of course be fixed to the streamer cables should it be desired to leave gaps resulting from explosions in the streamer rather than to reduce its overall length.

The form of protective equipment shown in FIG. 8 differs from the hereinbefore-described equipment in that the paravane cable 21 is eliminated and the paravane bridle is fitted with a pulley 85 riding on the intermediate portion of the electrically conductive insulated cable 37.

Various changes may be made in the forms of invention herein shown and described without departing from the spirit of the invention or the scope of the following claims.

We claim:

1. In equipment for the protection of a ship against torpedoes, a streamer comprising an electrically conductive insulated cable carrying a plurality of sections each including an explosive charge and an electronic echo ranging torpedo detector adapted to automatically fire the charge upon the approach of a torpedo within a predetermined distance from the detector, a source of alternating current for energizing the cable, individual inductive coupling means for supplying electrical energy from the cable to the electronic detector, and means maintaining the streamer spaced from the ship a distance greater than said predetermined distance and transversely of the normal path of travel of the torpedo.

2. In combination with a ship to be protected against torpedoes, an elongate member having one end portion attached to the ship at its bow, a water kite attached to the elongate member at its free end portion for extending the member laterally of the ship during forward travel thereof, a pulley carried at the free end portion of the elongate member, a towing winch on the ship, a cable having one end portion connected to the winch, an intermediate portion extending around said pulley and a free end portion adapted to trail in spaced parallel relation to the ship during forward travel thereof, a series of tubular explosive units longitudinally slidably supported on the trailing end portion of the cable, means automatically firing any given one of said explosive units upon the approach of a torpedo within a predetermined distance from said given unit, an abutment on the trailing portion to prevent sliding of said units off the free end of said cable, said winch being adapted to reduce the effective length of said trailing portion to eliminate any gaps in the series of explosive units.

3. In a torpedo guard for a ship, an elongate streamer comprising a plurality of explosive units disposed along the length of said streamer, spacer members between each of said explosive units to permit firing of any given one of said explosive units independently of other explosive units, means disposing and maintaining said streamer in spaced parallel relation to the ship upon forward travel thereof, and individual echo ranging torpedo detectors respectively associated with said explosive units for automatically firing a particular one of said units upon the approach of a torpedo within a predetermined distance from said given unit.

4. The torpedo guard specified in claim 3, said streamer including an electrically conductive insulated cable, a source of alternating current energizing the cable, said echo ranging torpedo detectors being electrically energizable, and inductive coupling means carried by said units for supplying said detectors with electrical energy from the cable.

5. In a torpedo guard for a ship, an elongate streamer comprising a plurality of units each including rigid tubular explosive sections and a flexible electrically conductive cable extending longitudinally through said sections, a source of alternating current energizing said cable, means for disposing said streamer in spaced relation to the ship and transversely of the normal path of travel of a torpedo directed toward the ship, and electrically energizable echo ranging devices provided with individual inductive coupling means for supplying electrical energy to said devices from said cable, said echo ranging devices being associated with said explosive sections for automatically firing any given one of said explosive sections upon the approach of a torpedo within a predetermined distance from said given section.

6. The torpedo guard specified in claim 5, said tubular sections including electrically insulative packings slidably engaging the cable to prevent the flow of seawater through the tubular sections.

7. In equipment for the protection of a ship against torpedoes, an electrically conductive insulated cable, a source of alternating current connected to the cable, means towing the cable underwater in spaced parallel relation to the ship during forward travel thereof, an electrode connected to the trailing end position of the cable, another electrode adjacent the forward end portion of the cable and connected to the current source whereby the cable is energized and the circuit completed by conduction through the water, explosive sections carried by the cable, electrically energizable echo ranging devices associated with said explosive sections for firing any given one of said sections upon the approach of a torpedo within a predetermined distance from said given section, and means supplying said devices with electrical energy from said cable.

8. In equipment of the character described, a source of alternating current, a submarine streamer comprising an insulated electrically conductive cable, a plurality of tubular units supported on the cable, each unit including rigid elongate explosive sections and an electrically energizable echo ranging device, said cable being connected to said alternating current source, and means transmitting electrical energy from the cable to said echo ranging devices, said devices being adapted to automatically fire an explosive section of any given unit upon the approach of a torpedo within a predetermined distance from said given unit.

9. In the equipment specified in claim 8, nonexplosive spacer sections on the cable between adjacent tubular units.

10. In the equipment specified in claim 8, the adjacent sections on said cable having paired end walls, one end wall of each pair being of concave curvature and the other end wall of each pair being of complementary convex curvature to permit angular misalignment of said sections.

11. In a torpedo guard, a cable, a series of explosive units strung on the cable, and individual proximity fuses positioned on said cable for each of said explosive units, the proximity fuse for any given explosive unit being adapted to fire said given unit upon the approach of a torpedo within a predetermined distance from said given unit.

12. In a torpedo guard, an electrically conductive cable, a series of explosive units strung on said cable, an individual proximity fuse for each of said explosive units, a source of electrical energy, means connecting said source of electrical energy to said cable, detecting means, an inductive coupling device connecting said cable to said detecting means, and means connecting said detecting means with said explosive units whereby said explosive units are adapted to be fired by said detecting means upon the approach of a torpedo.

13. In a torpedo guard, a source of electrical supply, an electrically conductive cable, means connecting said source of electrical supply with said cable, a plurality of inductive coupling devices secured to and spaced along the length of said cable, individual explosive firing systems electrically connected to each of said inductive coupling devices, each of said firing systems comprising a detecting means, a plurality of explosive units on said cable, means positioning said explosive units adjacent said detecting means and a fuse for said explosive units, whereby said detecting means explodes said explosive units upon the approach of a torpedo to said cable.

* * * * *